US009789711B2

(12) United States Patent
Mimoto et al.

(10) Patent No.: US 9,789,711 B2
(45) Date of Patent: Oct. 17, 2017

(54) CONVEYOR AND INK-JET RECORDING APPARATUS

(71) Applicant: BROTHER KOGYO KABUSHIKI KAISHA, Nagoya-shi, Aichi-ken (JP)

(72) Inventors: Masao Mimoto, Nagoya (JP); Yuta Uchino, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/299,845

(22) Filed: Oct. 21, 2016

(65) Prior Publication Data

US 2017/0113471 A1 Apr. 27, 2017

(30) Foreign Application Priority Data

Oct. 23, 2015 (JP) ..... 2015-209392

(51) Int. Cl.

| | |
|---|---|
| ***B41J 29/02*** | (2006.01) |
| ***B41J 11/00*** | (2006.01) |
| ***B41J 13/02*** | (2006.01) |
| ***B65H 5/06*** | (2006.01) |
| ***B41J 2/01*** | (2006.01) |
| ***B41J 11/04*** | (2006.01) |
| ***B65H 5/36*** | (2006.01) |

(52) U.S. Cl.

CPC ..... *B41J 13/025* (2013.01); *B41J 2/01* (2013.01); *B41J 11/007* (2013.01); *B41J 11/04* (2013.01); *B41J 29/02* (2013.01); *B65H 5/062* (2013.01); *B65H 5/36* (2013.01); *B65H 2404/15212* (2013.01); *B65H 2801/12* (2013.01)

(58) Field of Classification Search

CPC ..... B41J 29/02; B41J 11/007; B41J 13/025; B65H 5/062

See application file for complete search history.

(56) References Cited

U.S. PATENT DOCUMENTS

| | | | | |
|---|---|---|---|---|
| 7,040,819 | B2 * | 5/2006 | Takeshita | B41J 25/308 347/8 |
| 7,762,550 | B2 * | 7/2010 | Tanaami | B41J 11/0045 271/272 |
| 2014/0232799 | A1 * | 8/2014 | Sano | B41J 11/007 347/104 |
| 2015/0090561 | A1 | 4/2015 | Mimoto et al. | |

FOREIGN PATENT DOCUMENTS

| | | | |
|---|---|---|---|
| JP | 2015-67449 | A | 4/2015 |

* cited by examiner

*Primary Examiner* — Kristal Feggins
*Assistant Examiner* — Kendrick Liu
(74) *Attorney, Agent, or Firm* — Merchant & Gould P.C.

(57) ABSTRACT

A conveyor includes: a first roller; a second roller opposed to the first roller; a roller holder including a roller supporter; a frame supporting the roller holder and having a first surface and second surface; and a moving member that is moved to move the roller supporter. The roller holder includes: a contact portion that is located upstream of the roller supporter in a conveying direction and contacts the second surface; a thin portion disposed between the roller supporter and the contact portion; and an engaging portion engaged with the moving member at a position located downstream of the thin portion in the conveying direction. The roller supporter is moved from a first position to a second position by bending of the thin portion, which bending is caused when the engaging portion is moved away from the second roller with movement of the moving member.

10 Claims, 9 Drawing Sheets

CONVEYOR AND INK-JET RECORDING APPARATUS

CROSS REFERENCE TO RELATED APPLICATION

The present application claims priority from Japanese Patent Application No. 2015-209392, which was filed on Oct. 23, 2015, the disclosure of which is herein incorporated by reference in its entirety.

BACKGROUND

Technical Field

The following disclosure relates to a conveyor including a roller pair that conveys a sheet and to an ink-jet recording apparatus including the conveyor.

Description of the Related Art

There are known conveyors including a roller pair for conveying sheets. In the event of a jam of the sheet in an apparatus in a state in which the sheet is nipped by the roller pair, it is difficult to take out the jammed sheet. To solve this problem, a construction is proposed in which a roller pair is constituted by two rollers, and one of the rollers being in contact with each other is moved to come off the other roller. This construction facilitates takeout of the sheet.

There is known a conveyor having the above-described construction. This conveyor includes: a roller holder; a hook extending downward from a rear portion of the roller holder; and a metal frame. The hook is engaged with the metal frame through an opening formed in the metal frame. The roller holder is swung about a position at which the hook and the metal frame are engaged with each other. This swing moves one of rollers of the roller pair off the other roller.

SUMMARY

In the case where the conveyor has the above-described construction, however, variations of dimensions of the hook of the roller holder and the opening of the metal frame may unfortunately result in great variations of a position at which one of the rollers contacts the other roller. That is, there is a possibility of great variations of a nip position at which a sheet is nipped by the roller pair. The great variations of the nip position may lead to unstable conveyance of the sheet by the roller pair. For example, the variations may cause skew of the sheet nipped and conveyed by the roller pair.

Accordingly, an aspect of the disclosure relates to a conveyor having a construction in which one of rollers of a roller pair is movable to and away from the other roller, with small variations of a position at which a sheet is nipped by the roller pair.

In one aspect of the disclosure, a conveyor includes: a first roller; a second roller opposed to the first roller and configured to convey a sheet in a conveying direction in which the sheet is nipped between the first roller and the second roller; a roller holder including a roller supporter that supports the second roller rotatably, the roller supporter being movable between a first position at which the second roller is in contact with the first roller and a second position at which the second roller is spaced apart from the first roller; an urging member that urges the roller holder such that the roller supporter is moved toward the first position; a frame formed of metal and supporting the roller holder; and a moving member that is moved to move the roller supporter between the first position and the second position. The frame includes: a first portion having a first surface that contacts the urging member; and a second portion located upstream of the first portion in the conveying direction and having a second surface substantially orthogonal to the first surface and the conveying direction. The roller holder includes: a contact portion that is located upstream of the roller supporter in the conveying direction and contacts the second surface from a downstream side in the conveying direction; a thin portion disposed between the roller supporter and the contact portion in the conveying direction and having a thickness less than that of each of the roller supporter and the contact portion in a direction of movement of the roller supporter; and an engaging portion that is engaged with the moving member at a position located downstream of the thin portion in the conveying direction. The roller supporter is configured to be moved from the first position to the second position by bending of the thin portion, which bending is caused when the engaging portion is moved away from the second roller with movement of the moving member.

In another aspect of the disclosure, an ink-jet recording apparatus includes: a conveyor including (i) a first roller, (ii) a second roller opposed to the first roller and configured to convey a sheet in a conveying direction in which the sheet is nipped between the first roller and the second roller, (iii) a roller holder including a roller supporter that supports the second roller rotatably, the roller supporter being movable between a first position at which the second roller is in contact with the first roller and a second position at which the second roller is spaced apart from the first roller, (iv) an urging member that urges the roller holder such that the roller supporter is moved toward the first position, (v) a frame formed of metal and supporting the roller holder, and (vi) a moving member that is moved to move the roller supporter between the first position and the second position, the frame including (a) a first portion having a first surface that contacts the urging member; and (b) a second portion located upstream of the first portion in the conveying direction and having a second surface substantially orthogonal to the first surface and the conveying direction, the roller holder including a contact portion that is located upstream of the roller supporter in the conveying direction and contacts the second surface from a downstream side in the conveying direction, a thin portion disposed between the roller supporter and the contact portion in the conveying direction and having a thickness less than that of each of the roller supporter and the contact portion in a direction of movement of the roller supporter, and an engaging portion that is engaged with the moving member at a position located downstream of the thin portion in the conveying direction, the roller supporter being configured to be moved from the first position to the second position by bending of the thin portion, which bending is caused when the engaging portion is moved away from the second roller with movement of the moving member; a recording head disposed downstream of the first roller and the second roller in the conveying direction; and a platen that is opposed to the recording head and supports the sheet to be conveyed by the first roller and the second roller.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
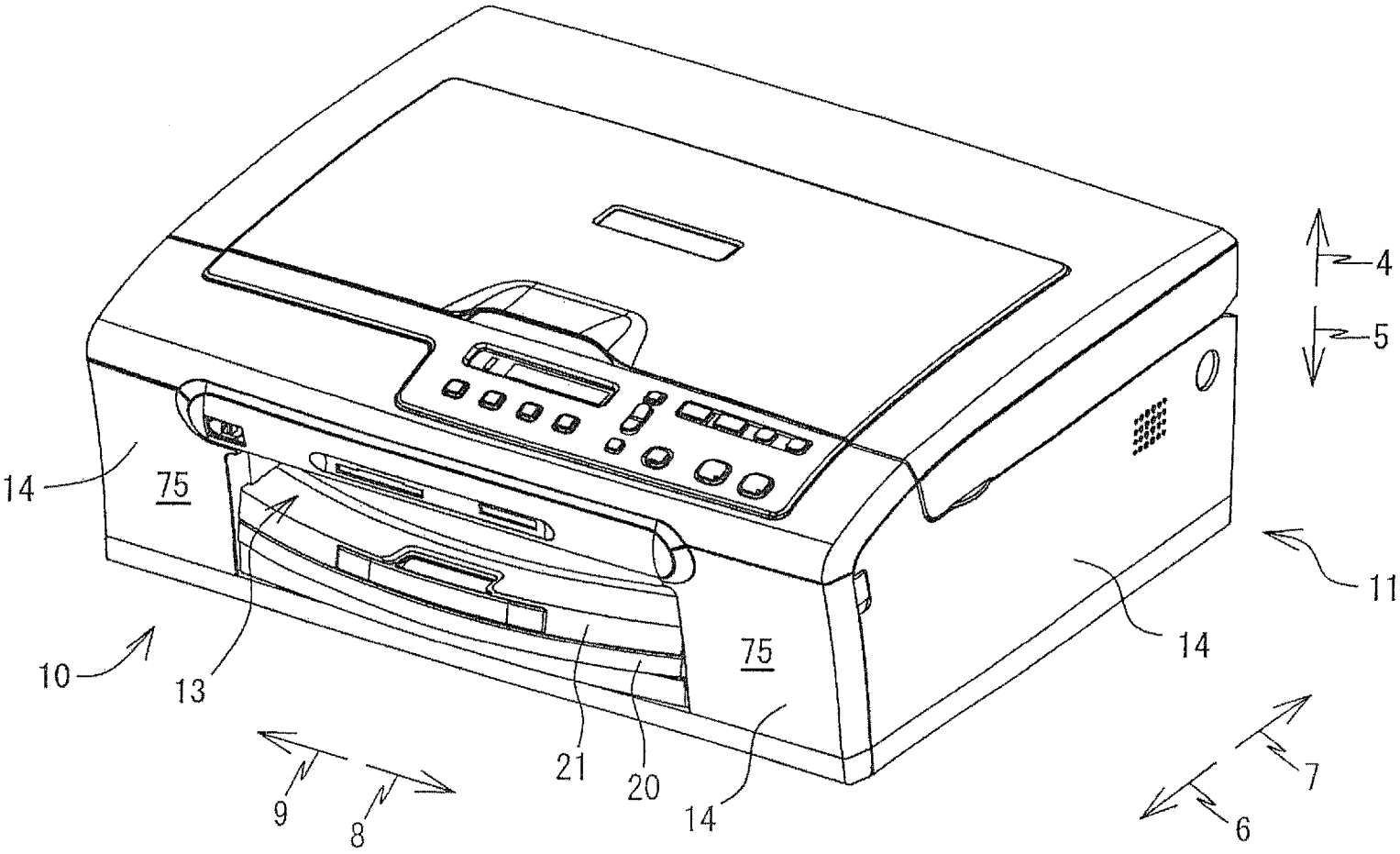
FIG. 1 is an external perspective view of a multi-function peripheral (MFP)

Hereinafter, there will be described embodiments by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the following explanation, up and down directions 4, 5 are defined in this state. Also, front and rear directions 6, 7 are defined by regarding a surface of the MFP 10 which has an opening 13 as a front surface 75. Right and left directions 8, 9 are defined in a state in which the MFP 10 is viewed in the rear direction 7. The up and down directions 4, 5 are opposite each other. The front and rear directions 6, 7 are opposite each other. The right and left directions 8, 9 are opposite each other. The up direction 4, the front direction 6, and the right direction 8 are orthogonal to each other.

Overall Construction of MFP 10

As illustrated in FIG. 1, the MFP 10 has a generally thin rectangular parallelepiped shape and includes a printer 11 in its lower portion. This printer 11 is one example of an ink-jet recording apparatus. This MFP 10 has various functions such as a facsimile function and a printing function. The MFP 10 has a function of ink-jet recording of an image on one side of a sheet 12 (see FIG. 2) and images on both sides of the sheet 12 as the printing function.

The printer 11 includes a conveyor that conveys the sheet 12. The conveyor includes a conveying roller pair 59 (see FIG. 2), an output roller pair 44 (see FIG. 2), a reversible pair 45 (see FIG. 2), a re-conveying roller pair 54 (see FIG. 2), a roller holder 85 (see FIG. 7), coil springs 86 (see FIG. 7), a moving member 53 (see FIG. 7), and a support frame 51 (see FIG. 7). Each of the coil springs 86 is one example of an urging member. The support frame 51 is one example of a frame.

Supply Tray 20

Figure 2:
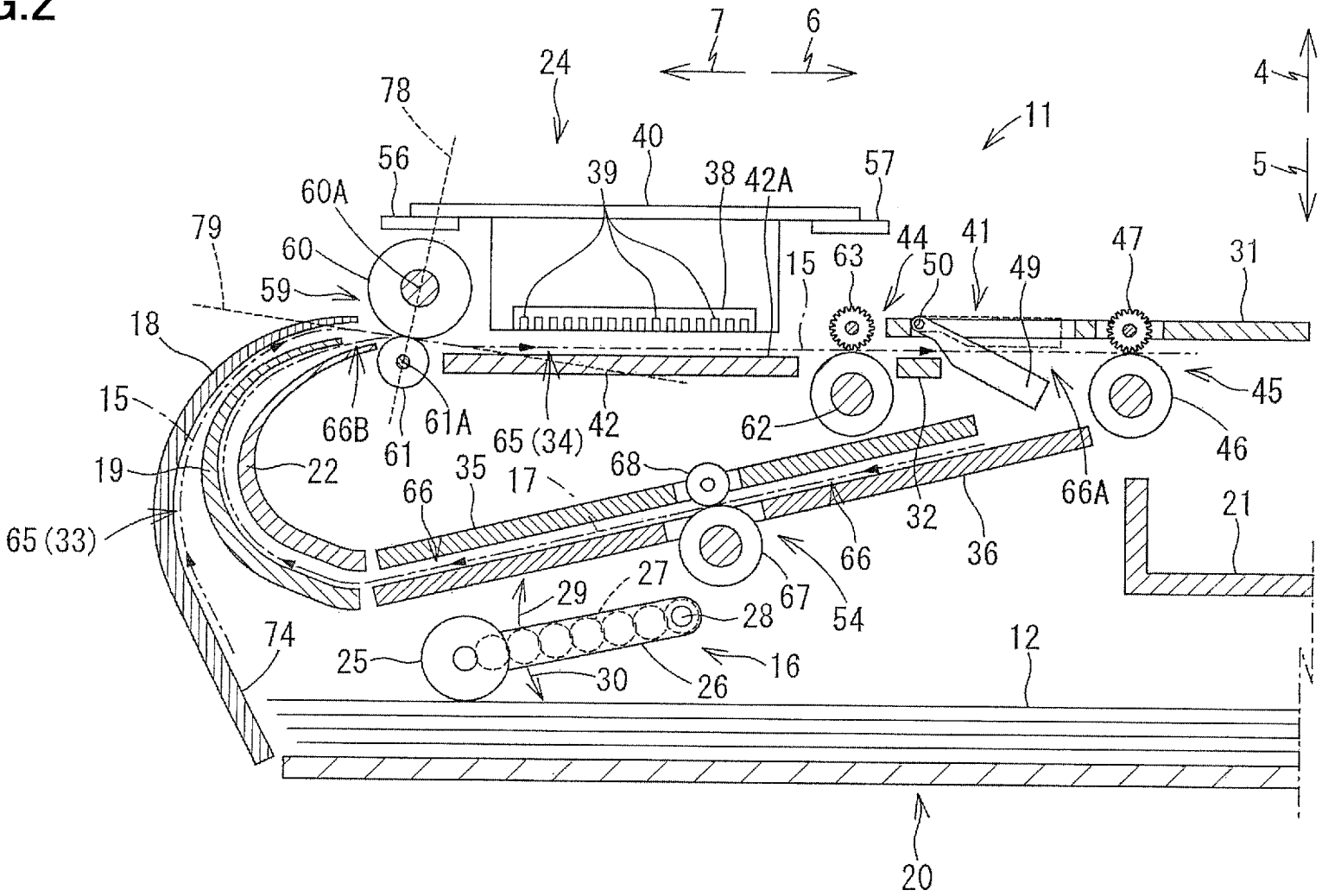
FIG. 2 is an elevational view in vertical cross section schematically illustrating an internal structure of a printer.

As illustrated in FIG. 1, the printer 11 includes a housing 14 having the front surface 75 formed with the opening 13. A supply tray 20 is inserted into the housing 14 through the opening 13 in the rear direction 7 and thereby mounted in the housing 14. The supply tray 20 is pulled out of the housing 14 through the opening 13 in the front direction 6 and thereby removed from the housing 14. An output tray 21 is supported by the supply tray 20 and moved with the supply tray 20. It is noted that the output tray 21 may be disposed in the housing 14 separately from the supply tray 20 and inserted in and removed from the housing 14 through the opening 13 independently of the supply tray 20. As illustrated in FIG. 2, the supply tray 20 is capable of supporting a plurality of stacked sheets 12. The supply tray 20 is shaped like a box opening upward.

Sheet Supplier 16

As illustrated in FIG. 2, a sheet supplier 16 is provided over the supply tray 20 in a state in which the supply tray 20 is mounted in the housing 14. The sheet supplier 16 includes a supply roller 25, a supply arm 26, and a drive-power transmitting mechanism 27. The supply roller 25 is rotatably supported at a distal end portion of the supply arm 26. A support shaft 28 is provided at a basal end portion of the supply arm 26. The supply arm 26 is swung about this support shaft 28 in directions indicated by arrows 29, 30. The operation of the supply arm 26 moves the supply roller 25 toward and away from the supply tray 20 or the sheet(s) 12 supported on the supply tray 20.

The supply roller 25 is rotated by a driving power transmitted from a motor, not illustrated, via the drive-power transmitting mechanism 27 that includes a plurality of gears. This rotation supplies an uppermost one of the sheets 12 supported on the supply tray 20, to a first conveyance path 65, with the supply roller 25 being in contact with the uppermost sheet 12. It is noted that the drive-power transmitting mechanism 27 may not include the plurality of gears and may include a belt looped over the support shaft 28 and a shaft of the supply roller 25, for example.

First Conveyance Path 65

As illustrated in FIG. 2, the first conveyance path 65 extends from a rear end portion of the supply tray 20 in the state in which the supply tray 20 is mounted in the printer 11. The first conveyance path 65 has a curved portion 33 and a straight portion 34. The curved portion 33 extends while being curved. The straight portion 34 extends in the front and rear directions 6, 7.

The curved portion 33 is defined by an outer guide member 18 and an intermediate guide member 19 opposed to and spaced apart from each other at a predetermined distance. At a region in which an image recorder 24 is not disposed, the straight portion 34 is defined by a first upper guide member 31 and a first lower guide member 32 opposed to and spaced apart from each other at a predetermined distance. At a region in which the image recorder 24 is disposed, the straight portion 34 is defined by the image recorder 24 and a platen 42 opposed to and spaced apart from each other at a predetermined distance.

The sheet 12 supported on the supply tray 20 is supplied by the supply roller 25 and conveyed so as to make an upward U-turn from the curved portion 33 and reach the conveying roller pair 59. The sheet 12 nipped by the conveying roller pair 59 is conveyed along the straight portion 34 in the front direction 6 in a state in which an image recording surface of the sheet 12 faces the image recorder 24. When the sheet 12 has reached a position just under the image recorder 24, the image recorder 24 records an image on the image recording surface of the sheet 12. After this image recording, the sheet 12 is conveyed along the straight portion 34 in the front direction 6. Thus, the sheet 12 is conveyed in a conveying direction 15 indicated by the one-dot-chain-line arrows illustrated in FIG. 2.

Second Conveyance Path 66

After the image recording, the sheet 12 is conveyed along a second conveyance path 66 (as one example of a conveyance path) illustrated in FIG. 2 in the case of two-side recording. During this conveyance, the sheet 12 is turned upside down and conveyed to the image recorder 24 again. In the present embodiment, the second conveyance path 66 is branched off from the first conveyance path 65 at a branch position 66A and merged with the first conveyance path 65 at a joining position 66B. The branch position 66A is located downstream of the image recorder 24 in the conveying direction 15. Specifically, the branch position 66A is located between the output roller pair 44 and the reversible pair 45 on the first conveyance path 65. The joining position 66B is located upstream of the image recorder 24 in the conveying direction 15. A conveying direction 17 in which the sheet 12 is conveyed on the second conveyance path 66 is indicated by the two-dot-chain-line arrows in FIG. 2. The second conveyance path 66 is defined by a second upper guide member 35, a second lower guide member 36, the intermediate guide member 19, and an inner guide member 22 as one example of a guide member. The second upper guide member 35 and the second lower guide member 36 are opposed to and spaced apart from each other at a predetermined distance in the housing 14. The inner guide member 22 will be described later in detail.

Image Recorder 24

As illustrated in FIG. 2, the image recorder 24 is provided above the straight portion 34 and includes a carriage 40 and a recording head 38. The platen 42 is provided under the image recorder 24 so as to be opposed to the image recorder 24. The platen 42 supports the sheet 12 conveyed on the straight portion 34.

Two guide rails 56, 57 are provided with a space therebetween in the front and rear directions 6, 7. The carriage 40 is supported by the guide rails 56, 57 so as to be reciprocable in the right and left directions 8, 9. The recording head 38 is mounted on the carriage 40. Ink is supplied to the recording head 38 from an ink cartridge, not illustrated. A multiplicity of nozzles 39 are formed in a lower surface of the recording head 38. During movement of the carriage 40, the recording head 38 ejects ink droplets from the nozzles 39 toward the platen 42. As a result, an image is recorded on the sheet 12 conveyed by the conveying roller pair 59 and supported on the platen 42.

Conveying Roller Pair 59, Output Roller Pair 44, Reversible Pair 45, and Re-Conveying Roller Pair 54

As illustrated in FIG. 2, the conveying roller pair 59 is disposed between the joining position 66B and the image recorder 24 on the straight portion 34. The conveying roller pair 59 includes a conveying roller 60 (as one example of a first roller) and pinch rollers 61 (each as one example of a second roller) opposed to each other. The conveying roller 60 is rotated by power transmitted from the motor, not illustrated. The pinch rollers 61 are rotated by the rotation of the conveying roller 60. The conveying roller pair 59 nips the sheet 12 and conveys it in the conveying direction 15. It is noted that the conveying roller 60 and the pinch rollers 61 will be described later in detail.

The output roller pair 44 is disposed on the straight portion 34 at a position located downstream of the image recorder 24 in the conveying direction 15. The output roller pair 44 includes an output roller 62 and spurs 63 opposed to each other. The output roller 62 is rotated by power transmitted from the motor, not illustrated. The spurs 63 are rotated by the rotation of the output roller 62. The output roller pair 44 nips the sheet 12 and conveys it in the conveying direction 15.

The reversible pair 45 is disposed on the straight portion 34 at a position located downstream of the output roller pair 44 in the conveying direction 15. The reversible pair 45 includes a reversible roller 46 and spurs 47 opposed to each other. The reversible roller 46 is rotated by power transmitted from the motor, not illustrated. The spurs 47 are rotated by the rotation of the reversible roller 46. The reversible pair 45 nips the sheet 12 and conveys it in the conveying direction 15 and a direction reverse to the conveying direction 15.

The re-conveying roller pair 54 is disposed on the second conveyance path 66. The re-conveying roller pair 54 includes a re-conveying roller 67 and a driven roller 68 opposed to each other. The re-conveying roller 67 is rotated by power transmitted from the motor, not illustrated. The driven roller 68 is rotated by the rotation of the re-conveying roller 67. The re-conveying roller pair 54 nips the sheet 12 and conveys it in the conveying direction 17.

It is noted that the rollers 60, 62, 46, 67 and the supply roller 25 may receive power from the same motor or different motors.

The conveying roller 60 is disposed over the pinch rollers 61 so as to be opposed to the pinch rollers 61.

Figure 3:
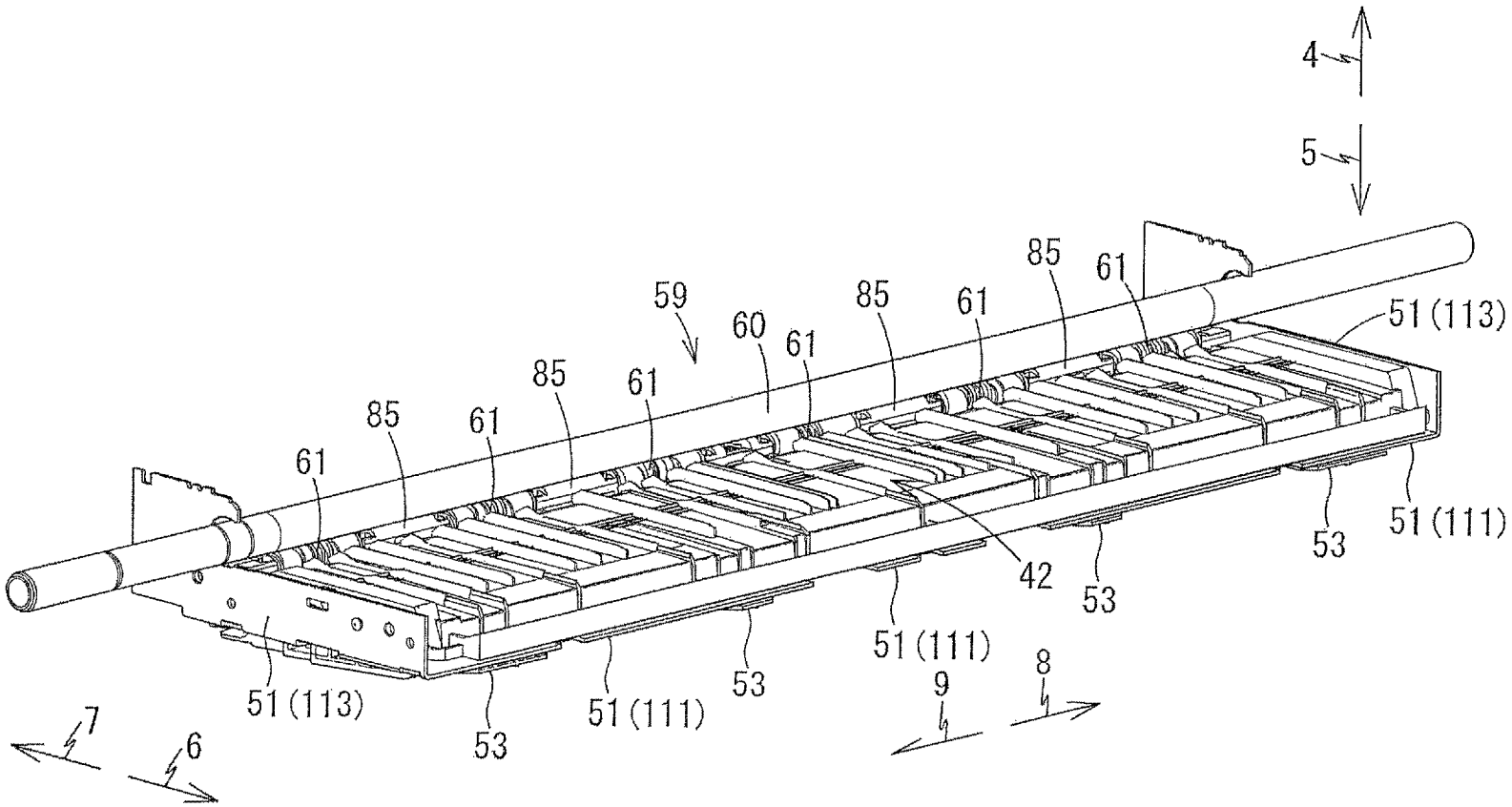
FIG. 3 is a perspective view of a platen, a conveying roller pair, and a support frame.

As illustrated in FIG. 3, the conveying roller 60 is a circular cylindrical member that is rotated about an axis extending in the right and left directions 8, 9. The conveying roller 60 is rotatably supported at its right and left end portions respectively by third portions 113 of the support frame 51, which will be described below, via bearings, not illustrated.

Figure 5A:
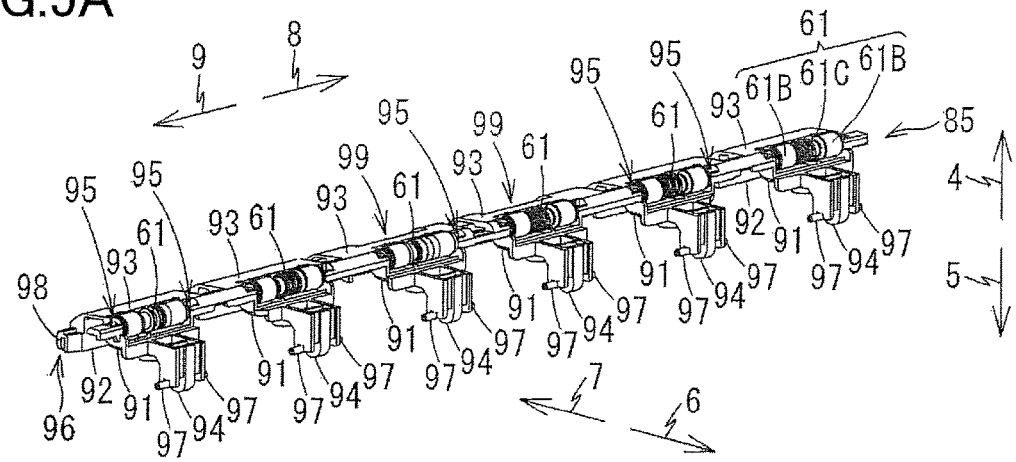
FIG. 5A is a perspective view of a roller holder.

As illustrated in FIG. 5A, each of the pinch rollers 61 is a circular cylindrical member that is rotated about an axis extending in the right and left directions 8, 9. The six pinch rollers 61 are provided so as to be spaced apart from each other in the right and left directions 8, 9. Each of the pinch rollers 61 includes: a pair of roller portions 61B spaced apart from each other in the right and left directions 8, 9 and contactable with a roller surface of the conveying roller 60; and a connecting portion 61C that connects the roller portions 61B to each other. Each of the pinch rollers 61 is rotatably supported by the roller holder 85 which will be described below. It is noted that the number of the pinch rollers 61 is not limited to six. Also, the construction of each of the pinch rollers 61 is not limited to the above-described construction. For example, each of the pinch rollers 61 may be constituted by a single roller portion 61B.

As illustrated in FIG. 2, a shaft 60A of the conveying roller 60 is located downstream of a shaft 61A of the pinch rollers 61 in the conveying direction 15. With this construction, an imaginary plane 79 orthogonal to an imaginary plane 78 containing the shaft 60A and the shaft 61A intersects an upper surface 42A of the platen 42 which supports the sheet 12. The upper surface 42A is one example of a sheet support surface.

Path Switcher 41

As illustrated in FIG. 2, a path switcher 41 is disposed between the output roller pair 44 and the reversible pair 45 on the straight portion 34. The path switcher 41 includes a flap 49 and a shaft 50. The flap 49 extends to the first conveyance path 65 from the shaft 50 supported by the first upper guide member 31. The flap 49 is pivotably supported by the shaft 50. The flap 49 is pivoted about the shaft 50 between a reverse position and a discharge position. The reverse position is indicated by the solid line in FIG. 2, and the flap 49 located at this reverse position closes the first conveyance path 65. The discharge position is indicated by the broken line in FIG. 2, and the flap 49 located at this discharge position allows passage of the sheet 12 along the first conveyance path 65. It is noted that the flap 49 may be moved between the reverse position and the discharge position by movement different from pivotal movement, for example, the flap 49 may be moved between the reverse position and the discharge position by movement in the up and down directions 4, 5.

In a normal state, the flap 49 is located at the reverse position by its own weight. It is noted that the flap 49 may be urged to the reverse position by an urging member such as a spring. The flap 49 is pivoted about the shaft 50 from the reverse position to the discharge position by being raised by the sheet 12 that is conveyed in the conveying direction 15 after image recording by the image recorder 24 on a front surface of the sheet 12. At the discharge position, the flap 49 guides the sheet 12 being conveyed in the conveying direction 15. When a trailing end of the sheet 12 conveyed in the conveying direction 15, i.e., an upstream end of the sheet 12 in the conveying direction 15 reaches the branch position 66A, the flap 49 is pivoted from the discharge position to the reverse position by its own weight.

When the reversible roller 46 of the reversible pair 45 continues rotating in the same direction in this state, the sheet 12 is conveyed in the conveying direction 15 and discharged onto the output tray 21. When the rotational direction of the reversible roller 46 is switched to the reverse direction, the sheet 12 is conveyed into the second conveyance path 66 in a state in which an upstream end of the sheet 12 in the conveying direction 15 serves as a leading end. The sheet 12 conveyed into the second conveyance path 66 is conveyed by the re-conveying roller pair 54 along the second conveyance path 66 in the conveying direction 17.

The sheet 12 is then conveyed through the first conveyance path 65 again after passing through the joining position 66B. The sheet 12 is then conveyed by the conveying roller pair 59 in the conveying direction 15 and arrives at the image recorder 24 again. In this state, a back surface of the sheet 12 faces the image recorder 24. The image recorder 24 records an image on the back surface of the sheet 12. The sheet 12 with the image recorded on its back surface by the image recorder 24 is conveyed by the output roller pair 44 and the reversible pair 45 in the conveying direction 15 and discharged onto the output tray 21.

Support Frame 51

Figure 7:
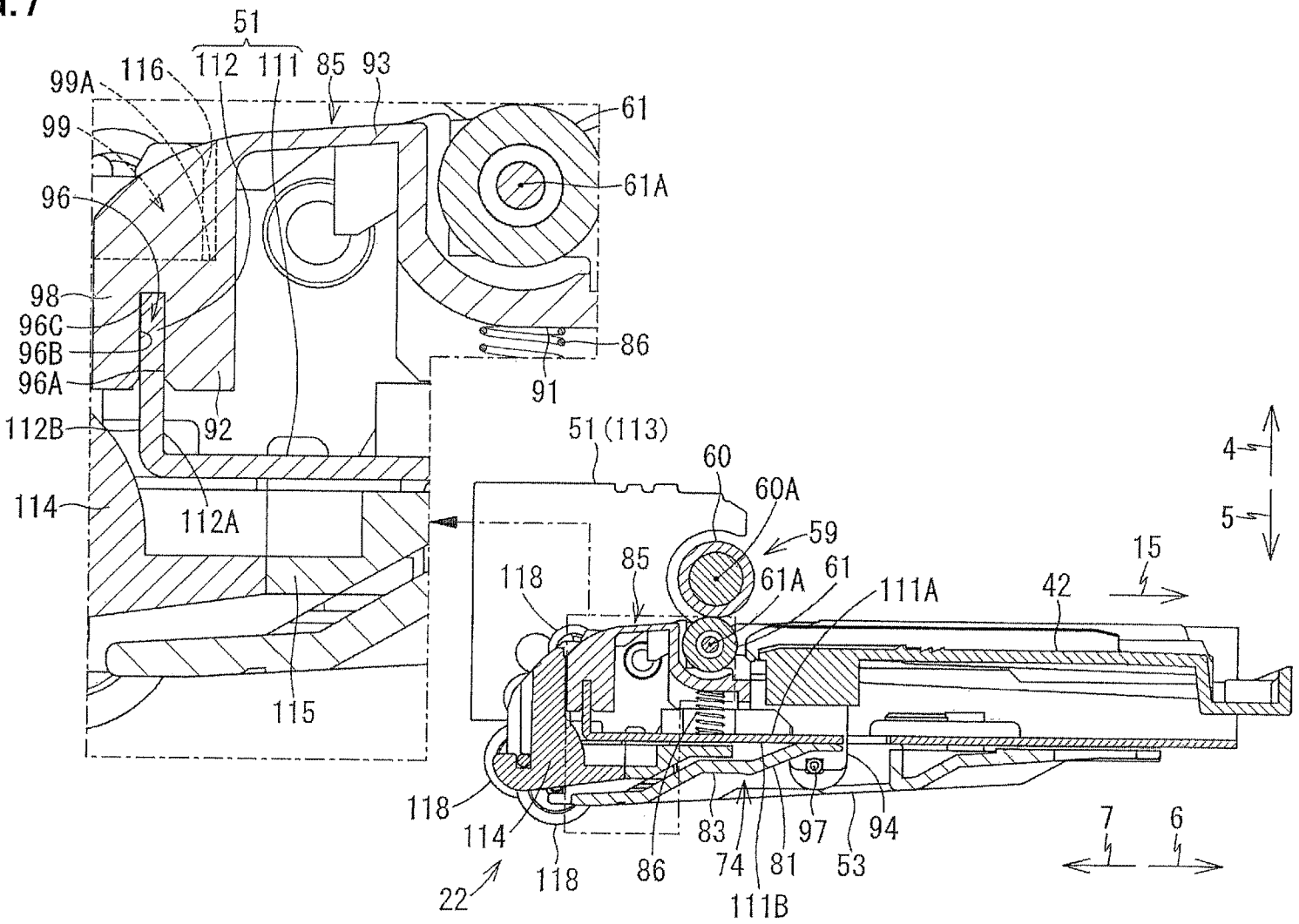
FIG. 7 is an elevational view in vertical cross section illustrating the platen, the conveying roller pair, and the support frame, with roller supporters of the roller holder being located at a first position.

As illustrated in FIGS. 3 and 7, the support frame 51 is disposed so as to cover lower, right, left, and rear surfaces of the platen 42. The support frame 51 is formed of metal. The support frame 51 includes a first portion 111, a second portion 112, and the third portions 113.

The first portion 111 is generally shaped like a plate extending in the front and rear directions 6, 7 and the right and left directions 8, 9. That is, an upper surface 111A and a lower surface 111B of the first portion 111 extend in the front and rear directions 6, 7 and the right and left directions 8, 9. The coil springs 86 which will be described below are in contact with the upper surface 111A as one example of a first surface.

The first portion 111 has a plurality of openings, not illustrated, spaced apart from each other in the right and left directions 8, 9. The openings are formed at positions respectively corresponding to engaging portions 94 of the roller holder 85 (see FIG. 5A) which will be described below.

As illustrated in FIG. 7, the second portion 112 is located upstream of the first portion 111 in the conveying direction 15. In the present embodiment, the second portion 112 protrudes in the up direction 4 from a rear end portion of the support frame 51 and extends in the right and left directions 8, 9. A front surface 112A of the second portion 112 (as one example of a second surface) is orthogonal to the upper surface 111A of the first portion 111. The front surface 112A faces in the conveying direction 15. That is, the front surface 112A faces frontward. A contact portion 92 of the roller holder 85 is in contact with the front surface 112A. The contact portion 92 will be described later in detail.

Figure 4:
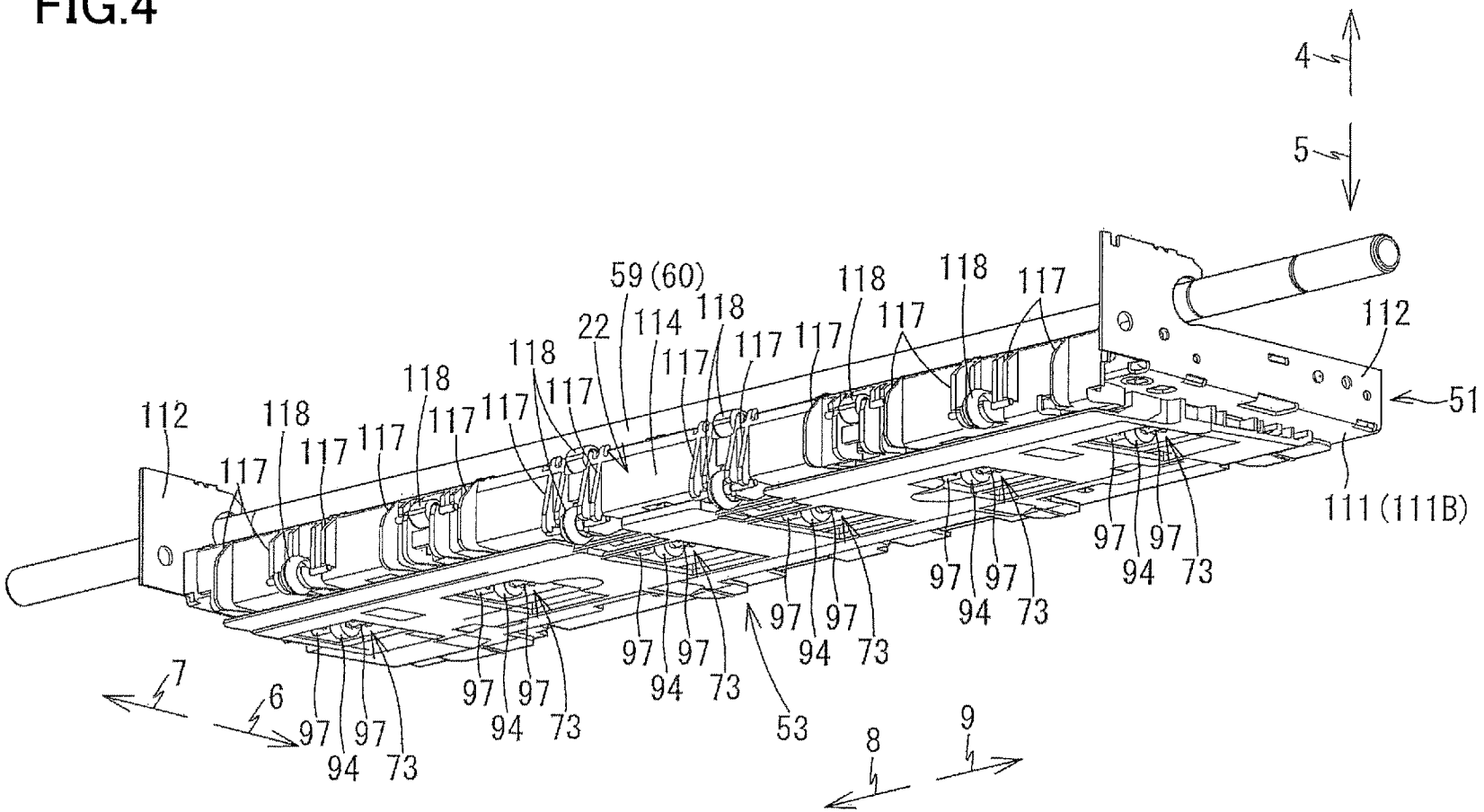
FIG. 4 is a perspective view of the platen, the conveying roller pair, and the support frame.

As illustrated in FIGS. 3 and 4, the third portions 113 are constituted as a pair. Specifically, the third portions 113 protrude in the up direction 4 respectively from right and left end portions of the support frame 51 and extend in the front and rear directions 6, 7. The pair of third portions 113 are respectively located to the right and left of the straight portion 34.

Roller Holder 85 and Coil Springs 86

As illustrated in FIG. 5A, the roller holder 85 supports the pinch rollers 61 such that the pinch rollers 61 are rotatable. The roller holder 85 is supported by the support frame 51 as will be described below.

While the one roller holder 85 supports the six pinch rollers 61 in the present embodiment, a plurality of the roller holders 85 may be provided to support some of the six pinch rollers 61. For example, this MFP 10 may be configured such that six roller holders 85 are provided, and each roller holder 85 supports a corresponding one of the pinch rollers 61. Also, the MFP 10 may be configured such that three roller holders 85 are provided, and each of the roller holders 85 supports corresponding two of the pinch rollers 61.

As illustrated in FIGS. 5A and 7, the roller holder 85 includes roller supporters 91, the contact portion 92, an opposed portion 98, thin portions 93, and the engaging portions 94.

Each of the roller supporters 91 supports a corresponding one of the pinch rollers 61. Each roller supporter 91 extends downward and is curved from a rear side to a lower side of the corresponding pinch roller 61. As illustrated in FIG. 5A, right and left end portions of each roller supporter 91 respectively have recesses 95 each recessed downward. The shaft 61A (see FIG. 7) protruding in the right and left directions 8, 9 from right and left ends of the pinch rollers 61 are fitted in the recesses 95 from an upper side thereof. As a result, the pinch rollers 61 are rotatably supported by the respective roller supporters 91.

Figure 6A:
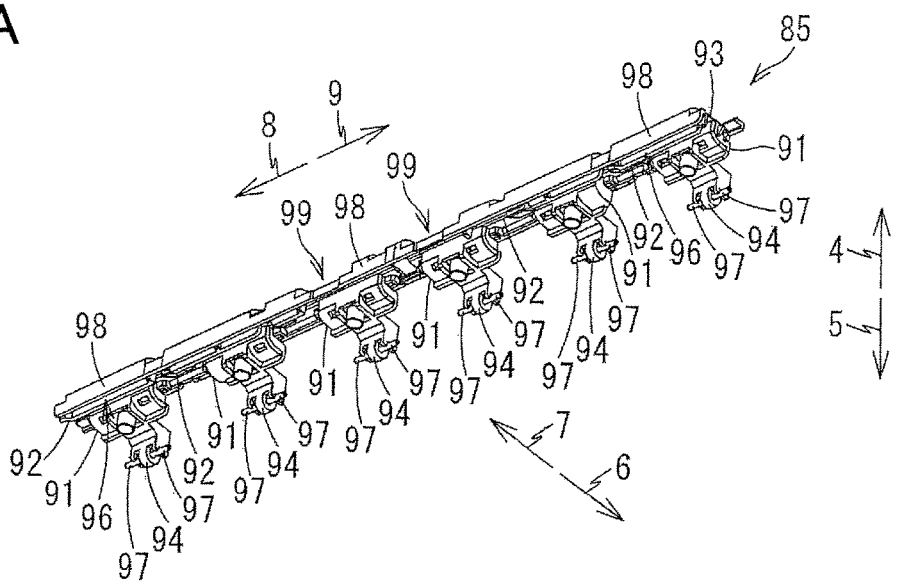
FIG. 6A is a perspective view of the roller holder.

As illustrated in FIG. 7, the contact portion 92 is provided at a rear of the roller supporters 91. That is, the contact portion 92 is provided upstream of the roller supporters 91 in the conveying direction 15. The opposed portion 98 is provided at a rear of the contact portion 92. The contact portion 92 and the opposed portion 98 are opposed to each other in the front and rear directions 6, 7. The contact portion 92 and the opposed portion 98 constitute a rear portion of the roller holder 85. The contact portion 92 and the opposed portion 98 extend downward at a rear of the thin portions 93. The contact portion 92 and the opposed portion 98 form a recess 96 that is recessed upward from lower ends of the contact portion 92 and the opposed portion 98. As illustrated in FIG. 6A, the recess 96 extends from a left end to a right end of the contact portion 92.

As illustrated in FIG. 7, the recess 96 is defined by (a) a side surface 96A that is a rear surface of the contact portion 92, (b) a side surface 96B that is a front surface of the opposed portion 98, and (c) a top surface 96C that connects between upper ends of the respective side surfaces 96A, 96B. The second portion 112 of the support frame 51 is fitted in the recess 96. The side surface 96A is in contact with the front surface 112A of the second portion 112. That is, the contact portion 92 is in contact with the front surface 112A from a downstream side thereof in the conveying direction 15. The side surface 96B is in contact with a rear surface 112B of the second portion 112. It is noted that the side surface 96B may not be in contact with the rear surface 112B. With these constructions, the second portion 112 is interposed between and held by the contact portion 92 and the opposed portion 98. The top surface 96C is in contact with an upper distal end of the second portion 112 protruding in the up direction 4.

As illustrated in FIGS. 5A and 6A, a rear portion of an upper surface of the roller holder 85 has two recesses 99 each recessed in the down direction 5. The recesses 99 are spaced apart from each other in the right and left directions 8, 9. Second protrusions 116 of the inner guide member 22 which will be described below are arranged in the respective recesses 99. It is noted that the recesses 99 are formed at two positions in the present embodiment because the two second protrusions 116 are provided. That is, the number of the recesses 99 is not limited to two, and the same number of the recesses 99 as the second protrusions 116 are formed.

The thin portions 93 are provided between the contact portion 92 and the roller supporters 91 in the conveying direction 15 (in the front and rear directions 6, 7). A front end of each of the thin portions 93 is continuous to an upper end portion of a corresponding one of the roller supporters 91, and a rear end portion of each thin portion 93 is continuous to an upper end portion of the contact portion 92. Each thin portion 93 is shaped like a plate extending in the front and rear directions 6, 7 and the right and left directions 8, 9. As illustrated in FIG. 7, the thickness of the thin portions 93, i.e., the length thereof in the up and down directions 4, 5, is less than that of each of the roller supporters 91 and the contact portion 92, i.e., the length thereof in the up and down directions 4, 5.

As illustrated in FIGS. 5A and 7, the engaging portions 94 are provided in front of the roller supporters 91, that is, the engaging portions 94 are provided downstream of the roller supporters 91 in the conveying direction 15. The engaging portions 94 constitute a front portion of the roller holder 85. Each of the engaging portions 94 is continuous to a front end portion of a corresponding one of the roller supporters 91 and extends downward from the front end portion. Each of the engaging portions 94 is provided with protrusions 97 protruding in the right and left directions 8, 9 from a lower end portion of the engaging portion 94. The protrusions 97 respectively contact cam portions 74 of the moving member 53 (see FIGS. 6C and 7) which will be described below, whereby the engaging portions 94 are engaged with the moving member 53.

Each of the engaging portions 94 is inserted through a corresponding one of openings, not illustrated, formed in the first portion 111 of the support frame 51 and through a corresponding one of openings 73 (see FIGS. 5C and 6C) formed in the moving member 53.

As illustrated in FIG. 7, the coil springs 86 are connected to the support frame 51 and the respective roller supporters 91. Specifically, an upper end of each of the coil springs 86 is connected to a lower surface of a corresponding one of the roller supporters 91, and a lower end of the coil spring 86 is connected to the upper surface 111A of the first portion 111 of the support frame 51. With this construction, the roller holder 85 is supported by the support frame 51, with the coil springs 86 interposed therebetween. As described above, the top surface 96C of the roller holder 85 which partly defines the recess 96 is in contact with the second portion 112 of the support frame 51. Also with this construction, the roller holder 85 is supported by the support frame 51.

Figure 8:
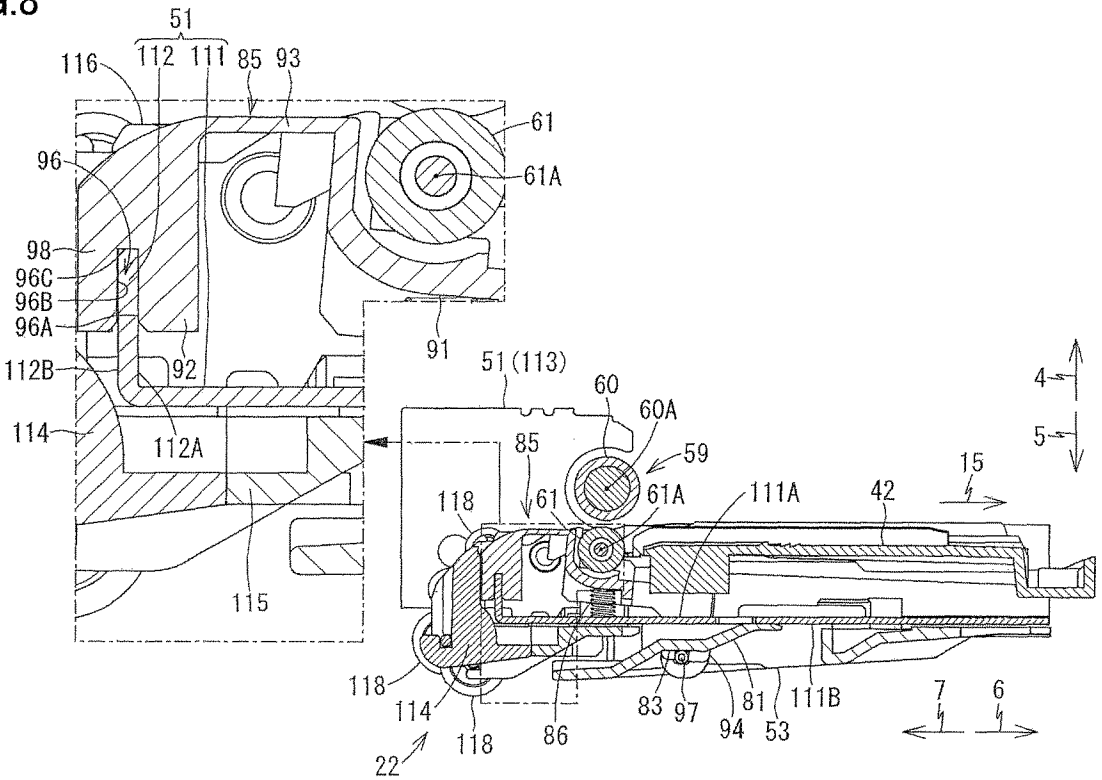
FIG. 8 is an elevational view in vertical cross section illustrating the platen, the conveying roller pair, and the support frame, with the roller supporters of the roller holder being located at a second position.

Each of the roller supporters 91 of the roller holder 85 is movable between a first position illustrated in FIG. 7 and a second position illustrated in FIG. 8 by extension and compression of the corresponding coil spring 86.

When the roller supporters 91 of the roller holder 85 are located at the first position, the pinch rollers 61 are in contact with the conveying roller 60, and the length of each coil spring 86 is less than its natural length. That is, the pinch rollers 61 are pressed against the conveying roller 60.

When the roller supporters 91 of the roller holder 85 are moved from the first position to the second position, the thin portions 93 are bent. Specifically, the thin portions 93 are bent such that their respective front end portions are moved downward. As a result, front portions of the respective roller supporters 91 of the roller holder 85 are located at a lower position when the roller supporters 91 are located at the second position than when the roller supporters 91 are located at the first position. When the roller supporters 91 of the roller holder 85 are located at the second position, all the six pinch rollers 61 are spaced apart from the conveying roller 60. In this state, the coil springs 86 are compressed more than when the roller supporters 91 of the roller holder 85 are located at the first position. That is, the coil springs 86 urge the roller holder 85 toward the first position. It is noted that when the roller supporters 91 of the roller holder 85 are located at the second position, the engaging portions 94 are engaged with the moving member 53, and accordingly the roller supporters 91 of the roller holder 85 are kept located at the second position even though the roller holder 85 is urged by the coil springs 86.

Inner Guide Member 22

As illustrated in FIG. 2, the inner guide member 22 defines a portion of the second conveyance path 66. Though not illustrated, the inner guide member 22 is supported by the support frame 51 by a well-known technique such as fitting.

Figure 5B:
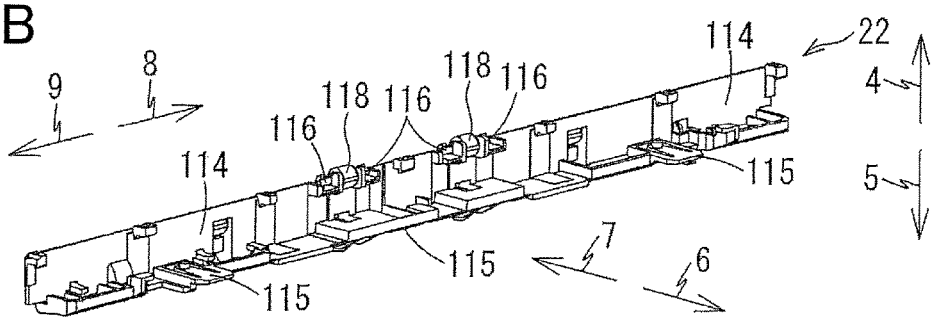
FIG. 5B is a perspective view of an inner guide member.

As illustrated in FIG. 5B, the inner guide member 22 includes: a main body 114 shaped like a plate extending in the up and down directions 4, 5 and the right and left directions 8, 9; a first protrusion 115 protruding frontward from a lower end portion of the main body 114; and the second protrusions 116 protruding frontward from an upper end portion of the main body 114. Each of the second protrusions 116 is one example of an extending guide portion.

As illustrated in FIG. 7, the main body 114 is located at a rear of the support frame 51 and the roller holder 85.

The first protrusion 115 is located below the support frame 51. The first protrusion 115 extends to a position just under the roller supporters 91 of the roller holder 85.

As illustrated in FIG. 5B, the two second protrusions 116 are spaced apart from each other in the right and left directions 8, 9. It is noted that the number of the second protrusions 116 is not limited to two. As indicated by the broken line in FIG. 7, each of the second protrusions 116 is located in a corresponding one of the recesses 99 formed in the roller holder 85 and in contact with a bottom surface 99A of the recess 99 from an upper side thereof. With this contact, the second protrusions 116 prevent upward movement of the contact portion 92 and the opposed portion 98.

As illustrated in FIG. 7, the second protrusions 116 extend to positions located in front of a position at which the contact portion 92 is in contact with the front surface 112A of the second portion 112 of the support frame 51, that is, the second protrusions 116 extend to the positions located downstream of the contact position in the conveying direction 15. The second protrusions 116 are located at a rear of the conveying roller pair 59, that is, the second protrusions 116 are located upstream of the conveying roller pair 59 in the conveying direction 15. That is, the second protrusions 116 extend from a position located upstream of the contact portion 92 in the conveying direction 15 to a position located downstream of the contact portion 92 (the contact position) in the conveying direction 15, on an upstream side of the pinch rollers 61 in the conveying direction 15.

Figure 6B:
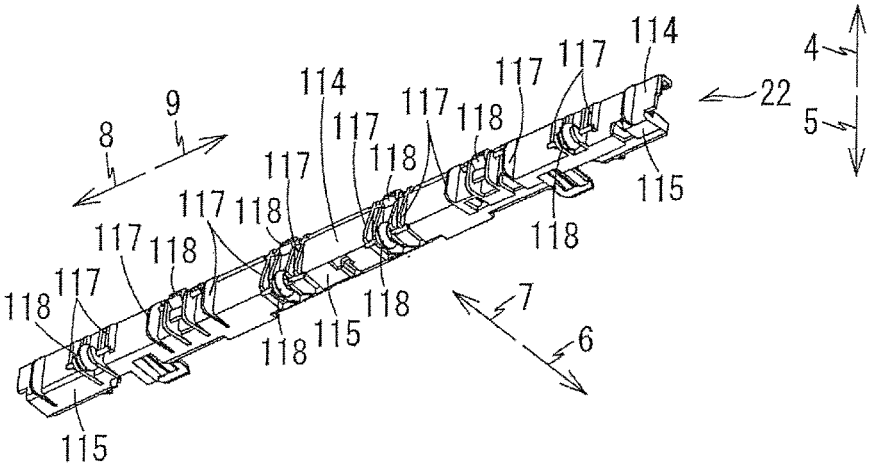
FIG. 6B is a perspective view of the inner guide member.

As illustrated in FIG. 6B, the inner guide member 22 is provided with ribs 117 extending along the second conveyance path 66 over an area extending from the first protrusion 115 to the main body 114. The sheet 12 is conveyed along the second conveyance path 66 while being guided by protruding distal end faces of the respective ribs 117.

As illustrated in FIGS. 5B and 6B, the inner guide member 22 supports a plurality of rollers 118 rotatably. When the sheet 12 conveyed along the second conveyance path 66 is brought into contact with the rollers 118, the rollers 118 are rotated and guide the sheet 12, enabling smooth conveyance of the sheet 12 along the second conveyance path 66.

Moving Member 53

As illustrated in FIGS. 4 and 7, the moving member 53 is provided below the support frame 51.

Figure 5C:
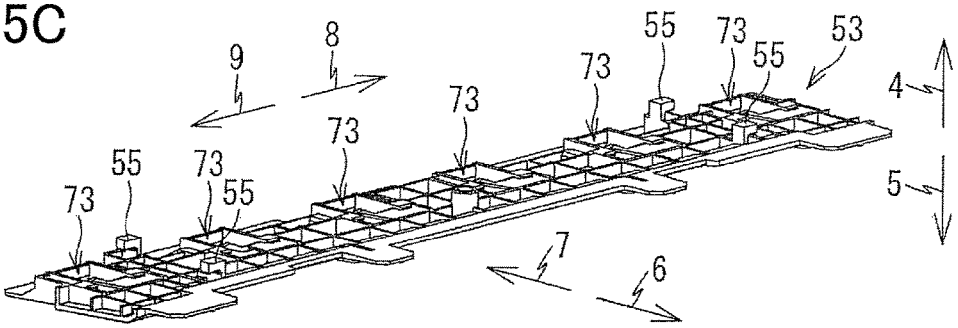
FIG. 5C is a perspective view of a moving member.

The moving member 53 is provided with protrusions 55 (see FIG. 5C). These protrusions 55 are respectively inserted in elongated holes, not illustrated, formed in the support frame 51, whereby the moving member 53 is supported by the support frame 51 so as to be movable in the front and rear directions 6, 7. Here, the protrusions 55 protrude upward from an upper surface of the moving member 53, and protruding distal end portions of the respective protrusions 55 are bent. The elongated holes are formed in the first portion 111 of the support frame 51 along the front and rear directions 6, 7. These constructions enable the moving member 53 to be moved in a direction parallel with the upper surface 111A of the first portion 111 of the support frame 51. As illustrated in FIGS. 4 and 7, the moving member 53 is supported in a state in which the moving member 53 is in contact with the lower surface 111B of the first portion 111 of the support frame 51 from a lower side thereof. The moving member 53 is kept in contact with the lower surface 111B during movement of the moving member 53. That is, the moving member 53 is movable with sliding contact with the support frame 51.

In the present embodiment, the moving member 53 is moved in conjunction with movement of a lever, not illustrated. The lever is disposed in front of the moving member 53. The lever is supported by the housing 14 so as to be movable in the front and rear directions 6, 7. A rear end portion of the lever is coupled to the moving member 53. A front end portion of the lever is exposed to an outside of the MFP 10 through the opening 13. When the front end portion of the lever is held and moved in the front direction 6 by a user of the MFP 10, the moving member 53 is moved in the front direction 6. When the front end portion of the lever is held and moved in the rear direction 7 by the user of the MFP 10, the moving member 53 is moved in the rear direction 7.

It is noted that the lever may be replaced with another component or construction to move the moving member 53. For example, the moving member 53 may be moved by being pressed by the supply tray 20 or the output tray 21 moving in the front and rear directions 6, 7. Alternatively, the moving member 53 may be moved by power transmitted from the motor, for example.

Figure 6C:
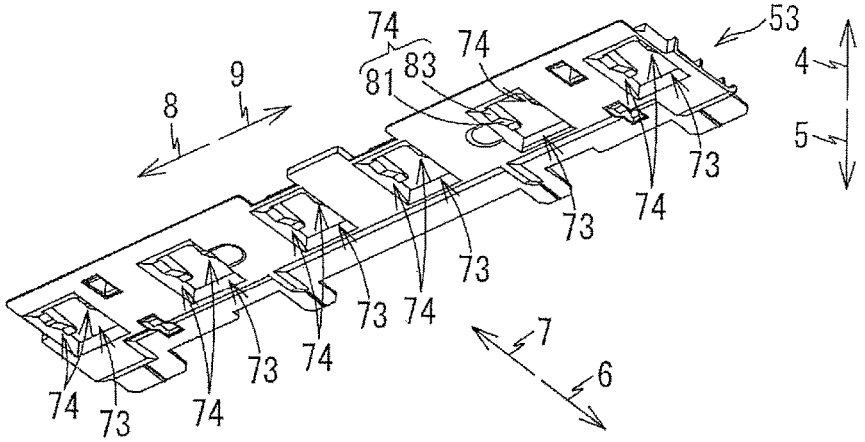
FIG. 6C is a perspective view of the moving member.

As illustrated in FIGS. 5C and 6C, the moving member 53 has the openings 73 spaced apart from each other in the right and left directions 8, 9. The openings 73 are formed at positions corresponding to the respective openings, not illustrated, formed in the first portion 111 of the support frame 51 in the right and left directions 8, 9. The engaging portions 94 of the roller holder 85 are inserted through the openings of the support frame 51 and the openings 73 of the moving member 53 from an upper side thereof. It is noted that the openings 73 are elongated in the front and rear directions 6, 7 such that the moving member 53 is movable in the state in which the engaging portions 94 are inserted through the openings 73.

As illustrated in FIG. 6C, a lower surface of the moving member 53 is provided with a plurality of cam portions 74. Each of the openings 73 is defined such that corresponding two of the cam portions 74 are respectively located to the right and left of the opening 73 and adjacent to the opening 73 in the right and left directions 8, 9. In other words, each of the openings 73 is interposed between the corresponding two cam portions 74 in the right and left directions 8, 9. That is, two cam portions 74 are formed for each of the openings 73. It is noted that the number of the cam portions 74 is not limited to two for each of the openings 73. For example, a single cam portion 74 may be formed for each of the openings 73.

Each of the cam portions 74 is a surface which faces in the down direction 5 and extends in the front and rear directions 6, 7. For each of the openings 73, the protrusion 97 protruding in the right direction 8 from the engaging portion 94 inserted through the opening 73 contacts a lower surface of the cam portion 74 formed to the right of the opening 73. For each of the openings 73, the protrusion 97 protruding in the left direction 9 from the engaging portion 94 inserted through the opening 73 contacts a lower surface of the cam portion 74 formed to the left of the opening 73.

Each of the cam portions 74 has an inclined surface 81 and a horizontal surface 83. The inclined surface 81 is inclined in the front direction 6 and the up direction 4. In other words, the inclined surface 81 is inclined so as to be nearer to a corresponding one of the pinch rollers 61 at a downstream portion of the inclined surface 81 in the conveying direction 15 than at an upstream portion of the inclined surface 81 in the conveying direction 15. The horizontal surface 83 is provided at a rear of the inclined surface 81 and continuous to a rear end of the inclined surface 81. The horizontal surface 83 extends in the front and rear directions 6, 7.

Movement of the lever moves the moving member 53 in the front and rear directions 6, 7 between a third position illustrated in FIG. 7 and a fourth position illustrated in FIG. 8. The third position is located at a rear of the fourth position.

As illustrated in FIG. 7, when the moving member 53 is located at the third position, the cam portions 74 are located at a rear of the respective protrusions 97 of the roller holder 85 and spaced apart from the respective protrusions 97. Thus, the roller supporters 91 of the roller holder 85 are moved upward by the urging forces of the coil springs 86. As a result, the roller supporters 91 of the roller holder 85 are located at the first position, and the pinch rollers 61 are in contact with the conveying roller 60. In this state, the pinch rollers 61 receive a reaction force from the conveying roller 60. Since the shaft 61A of the pinch rollers 61 is located upstream of the shaft 60A of the conveying roller 60 in the conveying direction 15, the reaction force acts in a direction inclined rearward with respect to the down direction 5. Thus, the reaction force contains a component in the rear direction 7. The rearward component acts as a force which presses the contact portion 92 against the front surface 112A of the second portion 112 of the support frame 51. It is noted that even if the reaction force does not contain the rearward component, the roller holder 85 is disposed such that the contact portion 92 is in contact with the support frame 51.

When the moving member 53 is moved frontward from the third position in this state by frontward movement of the lever pulled by the user, the inclined surfaces 81 are brought into contact with the respective protrusions 97. Further frontward movement of the moving member 53 moves the protrusions 97 downward along the respective inclined surfaces 81 against the urging forces of the respective coil springs 86. This movement moves the engaging portions 94 of the roller holder 85 such that the roller supporters 91 are moved from the first position to the second position. That is, the engaging portions 94 are moved downward.

During this movement, the thin portions 93 are to be bent such that their respective front end portions are moved downward. The reaction force containing the rearward component at this time is applied to the contact portion 92 located at a rear of the thin portions 93. The reaction force presses the contact portion 92 against the front surface 112A of the second portion 112 of the support frame 51. This pressing bends the thin portions 93 such that their respective front end portions are moved downward in a state in which the rear end portions of the respective thin portions 93 are fixed.

As illustrated in FIG. 8, when the moving member 53 has reached the fourth position, the inclined surfaces 81 are located in front of the respective protrusions 97. That is, when the moving member 53 is located at the fourth position, the horizontal surfaces 83 of the respective cam portions 74 are in contact with upper portions of the respective protrusions 97. The roller holder 85 is located at the second position at this time, and the pinch rollers 61 are spaced apart from the conveying roller 60.

As described above, the movement of the moving member 53 from the third position to the fourth position moves the engaging portions 94 to bend the thin portions 93, which moves the roller supporters 91 of the roller holder 85 from the first position to the second position.

When rearward movement of the lever pressed by the user moves the moving member 53 rearward from the fourth position in the state in which the moving member 53 is located at the fourth position, the horizontal surfaces 83 are moved to positions located at a rear of the protrusions 97, so that the inclined surfaces 81 contact the upper portions of the respective protrusions 97. When the moving member 53 is moved further rearward, the protrusions 97 are guided upward along the respective inclined surfaces 81 by the urging forces of the respective coil springs 86. As a result, the engaging portions 94 of the roller holder 85 are moved such that the roller supporters 91 are moved from the second position toward the first position. That is, the engaging portions 94 are moved upward. As a result, the bending of the thin portions 93 is canceled, in other words, the thin portions 93 are straightened.

As illustrated in FIG. 7, when the moving member 53 reaches the third position, the inclined surfaces 81 are located at a rear of the respective protrusions 97. At this time, the roller supporters 91 of the roller holder 85 are located at the first position, and the pinch rollers 61 are in contact with the conveying roller 60.

In view of the above, the moving member 53 is moved to move the roller supporters 91 of the roller holder 85 to the first position and the second position.

Effects

In the present embodiment, the contact portion 92 is in contact with the front surface 112A, whereby the roller holder 85 is positioned by the support frame 51. The roller supporters 91 of the roller holder 85 are moved between the first position and the second position by bending of the thin portions 93. With this construction, the contact portion 92 is kept in contact with the front surface 112A regardless of the position of the roller supporters 91 of the roller holder 85. That is, the contact portion 92 is kept positioned by the support frame 51 regardless of the position of the roller holder 85. Thus, even when the pinch rollers 61 are brought into contact with or separated from the conveying roller 60 by the movement of the roller supporters 91 of the roller holder 85, the conveying roller pair 59 can stably nip the sheet 12 at its nip position. This stabilizes accuracy of conveyance of the sheet 12.

In the present embodiment, when the movement of the moving member 53 in the front and rear directions 6, 7 applies a force directed from the first position toward the second position, to a portion of the roller holder 85 which is located downstream of the thin portions 93 in the conveying direction 15, the force in a direction in which the contact portion 92 of the roller holder 85 is pressed against the front surface 112A is applied to the contact portion 92. Thus, even when the moving member 53 is moved, the roller holder 85 is kept positioned by the support frame 51.

In the present embodiment, the moving member 53 is moved in the state in which the moving member 53 is in contact with the first portion 111 of the support frame 51. That is, the moving member 53 is moved in the state in which the moving member 53 is positioned by the support frame 51. This construction improves accuracy of movement of the roller supporters 91 of the roller holder 85 moved by the moving member 53. This improvement improves accuracy of movement of the pinch rollers 61 supported by the roller holder 85.

In the present embodiment, the engaging portions 94 are guided by the inclined surface 81 in a process of the movement of the moving member 53, whereby the force directed from the first position toward the second position is applied to the portion of the roller holder 85 which is located downstream of the thin portions 93 in the conveying direction 15. In this state, the force in the direction in which the contact portion 92 of the roller holder 85 is pressed against the front surface 112A is applied to the contact portion 92. Thus, the roller holder 85 is kept positioned by the support frame 51 in the state in which the moving member 53 is moved.

In the present embodiment, the inner guide member 22 prevents upward movement of the contact portion 92.

In the present embodiment, the roller holder 85 can be assembled to the support frame 51 in the state in which the second portion 112 of the support frame 51 is held between the contact portion 92 and the opposed portion 98. This construction facilitates assembly of the roller holder 85.

In the present embodiment, the contact portion 92 is in contact with the front surface 112A of the second portion 112. Thus, all the pinch rollers 61 are positioned by the second portion 112. This construction reduces variations of the position of the nipping of the sheet 12 by the conveying roller pair 59 in the right and left directions 8, 9. This reduction enables stable conveyance of the sheet 12. For example, it is possible to reduce occurrence of skew of the sheet 12.

In the present embodiment, the shaft 60A of the conveying roller 60 is located downstream of the shaft 61A of the pinch rollers 61 in the conveying direction 15. Thus, the force applied from the conveying roller 60 to the pinch rollers 61 contains the component in the rear direction 7, i.e., in the direction in which the contact portion 92 is pressed against the front surface 112A, in the state in which the conveying roller 60 and the pinch rollers 61 are in contact with each other. This construction enables reliable positioning of the roller holder 85 in the state in which the conveying roller 60 and the pinch rollers 61 are in contact with each other.

Modifications

Figure 9A:
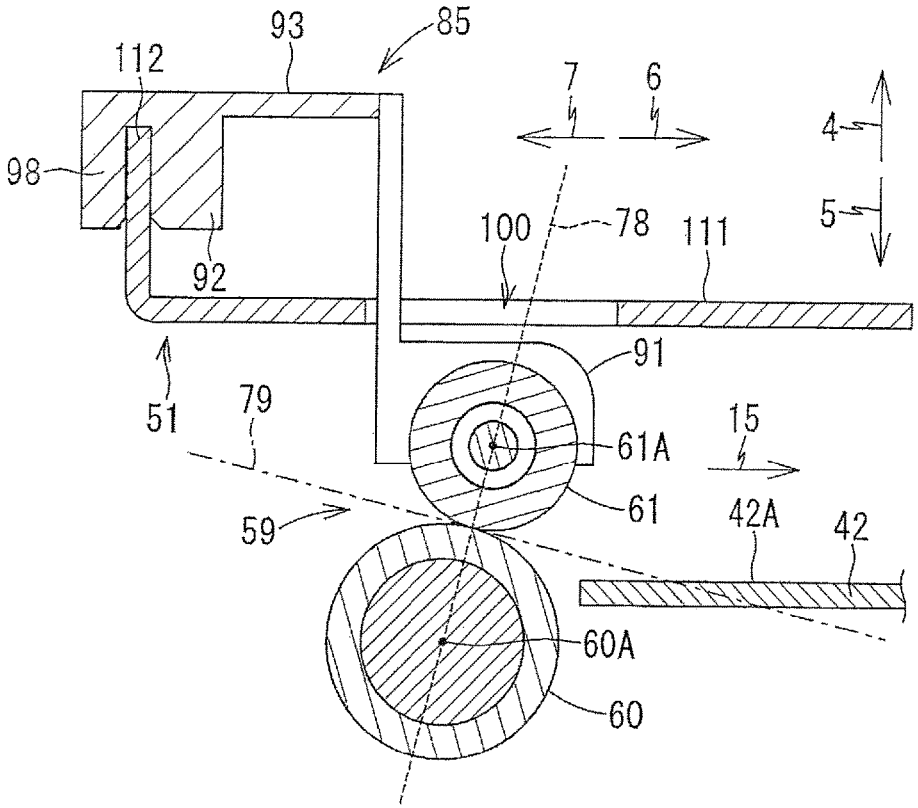
FIGS. 9A and 9B are cross-sectional views each schematically illustrating a roller holder in a modification.

While the conveying roller 60 is disposed over the pinch rollers 61 in the conveying roller pair 59 in the above-described embodiment, the pinch rollers 61 may be disposed over the conveying roller 60. In this case, arrangement of the roller holder 85 and the support frame 51 differs from that in the above-described embodiment as illustrated in FIG. 9A as one example. In the construction illustrated in FIG. 9A, the shaft 61A of the pinch rollers 61 is located downstream of the shaft 60A of the conveying roller 60 in the conveying direction 15. The imaginary plane 79 orthogonal to the imaginary plane 78 containing the shaft 60A and the shaft 61A intersects the upper surface 42A of the platen 42 which supports the sheet 12. The support frame 51 is located above the pinch rollers 61. The support frame 51 has an opening 100, and the roller holder 85 extends upward through the opening 100 from a position located under the support frame 51. The contact portion 92, the opposed portion 98, and the thin portions 93 are located over the support frame 51. It is noted that FIG. 9A omits illustration of the engaging portions 94 and the coil springs 86.

Figure 9B:
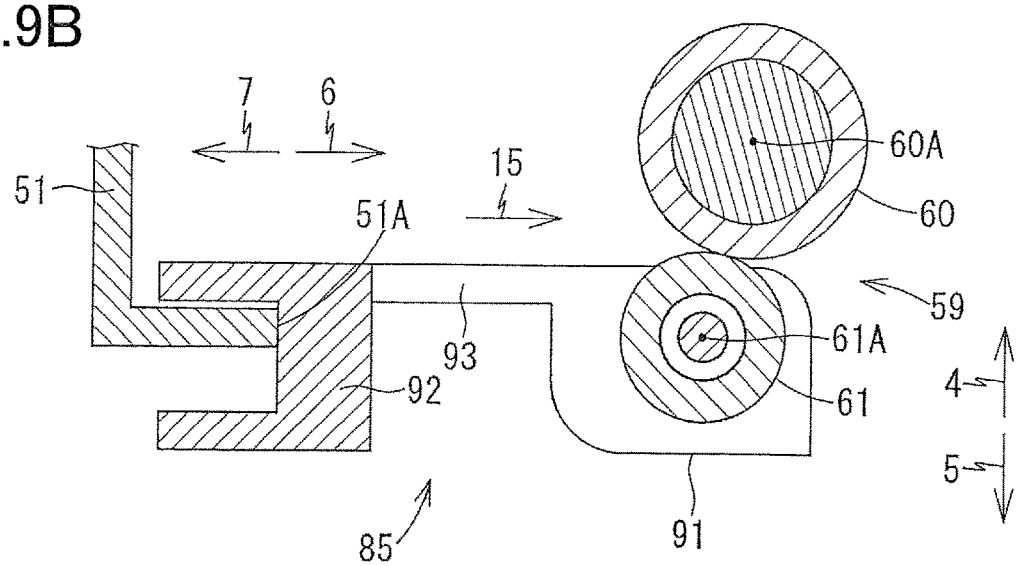

In the above-described embodiment, the contact portion 92 is in contact with the front surface 112A of the second portion 112 of the support frame 51. However, the surface with which the contact portion 92 is in contact is not limited to the front surface 112A of the second portion 112 as long as the surface faces to a downstream side in the conveying direction 15. For example, as illustrated in FIG. 9B, the MFP 10 may be configured such that the support frame 51 has a side surface 51A which faces to a downstream side in the conveying direction 15, and the contact portion 92 may be in contact with the side surface 51A from a downstream side thereof in the conveying direction 15. It is noted that FIG. 9B omits illustration of the engaging portions 94 and the coil springs 86.

In the above-described embodiment, the roller holder 85 is formed by molding the roller supporters 91, the contact portion 92, the opposed portion 98, the thin portions 93, and the engaging portions 94 as one component. However, the roller holder 85 may be formed as one component. For example, the roller holder 85 may include: a front portion formed by molding the roller supporters 91 and the engaging portions 94 as one component; a rear portion formed by molding the contact portion 92 and the opposed portion 98 as one component; and leaf springs as the thin portions 93. Front end portions of the respective leaf springs are coupled to the front portion, and rear end portions of the respective leaf springs are coupled to the rear portion.

The second conveyance path 66 may have a construction different from the construction illustrated in FIG. 2 as long as the sheet 12 on which an image has been recorded by the image recorder 24 is turned upside down and conveyed to the image recorder 24 again. For example, the MFP 10 may be configured such that the branch position 66A is located upstream of the image recorder 24 in the conveying direction 15, and the joining position 66B is located upstream of the branch position 66A in the conveying direction 15.

While the MFP 10 has the function for recording images on both sides of the sheet 12 in the above-described embodiment, the MFP 10 may only have the function for recording an image on only one side of the sheet 12. In this case, the MFP 10 need not include the components for recording images on both sides of the sheet 12, such as the inner guide member 22, the second upper guide member 35, the second lower guide member 36, the path switcher 41, and the reversible pair 45. In this case, the intermediate guide member 19 defining the curved portion 33 is one example of the guide member and has a function similar to that of the inner guide member 22 in the above-described embodiment. For example, upward movement of the contact portion 92 and the opposed portion 98 is prevented by contact of the contact portion 92 or the opposed portion 98 with the intermediate guide member 19 from a lower side thereof.

While the moving member 53 is moved in the front and rear directions 6, 7 in the above-described embodiment, the direction of the movement of the moving member 53 is not limited to the front and rear directions 6, 7.

For example, the moving member 53 may be moved in the up and down directions 4, 5 and moved in the down direction 5 to press and move the roller supporters 91 of the roller holder 85 downward. In the case of the construction illustrated in FIG. 9A, the moving member 53 is moved in the up direction 4 to press and move the roller supporters 91 of the roller holder 85 upward.

The moving member 53 may be swung, for example. In this case, the moving member 53 may be swung in the clockwise direction in FIG. 7 to press upper surfaces of the roller supporters 91 of the roller holder 85, for example. It is noted that in the case of the construction illustrated in FIG. 9A, the moving member 53 is swung in the counterclockwise direction in FIG. 7 to press lower surfaces of the roller supporters 91 of the roller holder 85.

While the conveyor is provided in the printer 11 as one example of the ink-jet recording apparatus in the above-described embodiment, the conveyor may be provided in devices other than the printer 11. For example, the conveyor may be provided in a scanner. In this case, the conveyor conveys a document on which an image to be read by the scanner is formed.

What is claimed is:

1. A conveyor, comprising:

a first roller;

a second roller opposed to the first roller and configured to convey a sheet in a conveying direction in which the sheet is nipped between the first roller and the second roller;

a roller holder comprising a roller supporter that supports the second roller rotatably, the roller supporter being movable between a first position at which the second roller is in contact with the first roller and a second position at which the second roller is spaced apart from the first roller;

an urging member that urges the roller holder such that the roller supporter is moved toward the first position;

a frame formed of metal and supporting the roller holder; and a moving member that is moved to move the roller supporter between the first position and the second position, the frame comprising:

a first portion comprising a first surface that contacts the urging member; and a second portion located upstream of the first portion in the conveying direction and comprising a second surface substantially orthogonal to the first surface and the conveying direction, the roller holder comprising:

a contact portion that is located upstream of the roller supporter in the conveying direction and contacts the second surface from a downstream side in the conveying direction;

a thin portion disposed between the roller supporter and the contact portion in the conveying direction and having a thickness less than that of each of the roller supporter and the contact portion in a direction of movement of the roller supporter; and an engaging portion that is engaged with the moving member at a position located downstream of the thin portion in the conveying direction, the roller supporter being configured to be moved from the first position to the second position by bending of the thin portion, which bending is caused when the engaging portion is moved away from the second roller with movement of the moving member.

2. The conveyor according to claim 1, wherein the moving member is configured to be moved while being in engagement with the engaging portion to move the roller supporter to the second position.

3. The conveyor according to claim 1, wherein the moving member is configured to be moved in a direction parallel with the first surface.

4. The conveyor according to claim 1, wherein the moving member is configured to be moved in a state in which the moving member is in contact with the first portion of the frame.

5. The conveyor according to claim 1, wherein the moving member comprises an inclined surface inclined so as to be nearer to the second roller at a downstream portion of the inclined surface in the conveying direction than at an upstream portion of the inclined surface in the conveying direction, and wherein the inclined surface is configured to guide the engaging portion in a process of the movement of the moving member in a state in which the inclined surface is in contact with the engaging portion.

6. The conveyor according to claim 1, further comprising a guide member supported by the frame and defining a path on which the sheet is to be conveyed, wherein the guide member comprises an extending guide portion located upstream of the second roller in the conveying direction and extending from a position located upstream of the contact portion in the conveying direction to a position located downstream of the contact portion in the conveying direction.

7. The conveyor according to claim 1, wherein the roller holder further comprises an opposed portion located upstream of the contact portion in the conveying direction and located at a position at which the second portion is interposed between the opposed portion and the contact portion.

8. The conveyor according to claim 1, further comprising a plurality of second rollers each as the second roller, wherein the plurality of second rollers are spaced apart from each other in a direction orthogonal to the conveying direction, and wherein each of the plurality of second rollers is spaced apart from the first roller when the roller supporter is located at the second position.

9. An ink-jet recording apparatus, comprising:

a conveyor comprising (i) a first roller, (ii) a second roller opposed to the first roller and configured to convey a sheet in a conveying direction in which the sheet is nipped between the first roller and the second roller, (iii) a roller holder comprising a roller supporter that supports the second roller rotatably, the roller supporter being movable between a first position at which the second roller is in contact with the first roller and a second position at which the second roller is spaced apart from the first roller, (iv) an urging member that urges the roller holder such that the roller supporter is moved toward the first position, (v) a frame formed of metal and supporting the roller holder, and (vi) a moving member that is moved to move the roller supporter between the first position and the second position, the frame comprising (a) a first portion comprising a first surface that contacts the urging member; and (b) a second portion located upstream of the first portion in the conveying direction and comprising a second surface substantially orthogonal to the first surface and the conveying direction, the roller holder comprising a contact portion that is located upstream of the roller supporter in the conveying direction and contacts the second surface from a downstream side in the conveying direction, a thin portion disposed between the roller supporter and the contact portion in the conveying direction and having a thickness less than that of each of the roller supporter and the contact portion in a direction of movement of the roller supporter, and an engaging portion that is engaged with the moving member at a position located downstream of the thin portion in the conveying direction, the roller supporter being configured to be moved from the first position to the second position by bending of the thin portion, which bending is caused when the engaging portion is moved away from the second roller with movement of the moving member;

a recording head disposed downstream of the first roller and the second roller in the conveying direction; and a platen that is opposed to the recording head and supports the sheet to be conveyed by the first roller and the second roller.

10. The ink-jet recording apparatus according to claim 9, wherein an imaginary plane substantially orthogonal to an imaginary plane containing an axis of the first roller and an axis of the second roller intersects a sheet support surface of the platen in a state in which the first roller and the second roller are in contact with each other.

* * * * *